US006026934A

United States Patent [19]

Deurloo

[11] Patent Number: 6,026,934

[45] Date of Patent: Feb. 22, 2000

[54] HYDRAULIC LIFT WITH YOKED CYLINDERS

[75] Inventor: John M. Deurloo, Grand Rapids, Mich.

[73] Assignee: Monarch Hydraulics, Inc., Grand Rapids, Mich.

[21] Appl. No.: 09/105,789

[22] Filed: Jun. 26, 1998

[51] Int. Cl.[7] ..... B66B 9/04

[52] U.S. Cl. ..... 187/274; 60/581

[58] Field of Search ..... 60/533, 562, 581; 108/20, 147.19; 187/274, 272, 215, 234

[56] References Cited

U.S. PATENT DOCUMENTS

| | | | |
|---|---|---|---|
| 4,351,153 | 9/1982 | Kosmala | 60/581 |
| 4,363,380 | 12/1982 | Rued et al. | 187/274 |
| 4,567,727 | 2/1986 | Grams | 60/581 X |
| 4,683,988 | 8/1987 | Shrum, Jr. | 187/234 |
| 4,810,160 | 3/1989 | Emiliani et al. | 187/234 |
| 4,825,655 | 5/1989 | Buchl et al. | 60/546 |
| 4,903,946 | 2/1990 | Stark | 254/45 |
| 4,930,971 | 6/1990 | Wilson | 187/234 |
| 5,161,449 | 11/1992 | Everett, Jr. | 60/562 X |
| 5,320,047 | 6/1994 | Deurloo et al. | 108/20 |
| 5,330,032 | 7/1994 | Warner | 187/234 |
| 5,636,713 | 6/1997 | Perkins et al. | 187/274 |

FOREIGN PATENT DOCUMENTS

| | | | |
|---|---|---|---|
| 1308011 | 9/1962 | France | 187/274 |
| 2004248 | 3/1979 | United Kingdom | 187/274 |

*Primary Examiner*—Dean J. Kramer
*Assistant Examiner*—Thuy V. Tran
*Attorney, Agent, or Firm*—Warner Norcross & Judd LLP

[57] ABSTRACT

A hydraulic lift system including a master cylinder, a plurality of slave cylinders, a yoke interconnecting the master and slave cylinders, and a plurality of lift cylinders each in fluid communication with one of the slave cylinders. The extension of the master cylinder moves the yoke, which causes the simultaneous coordinated movement of the slave cylinders. Equal volumes of hydraulic fluid are forced out of, or permitted into, each of the slave cylinders and into, or out of, the lift cylinders, thus extending the lift cylinders in simultaneous coordinated movement. When the cylinders are vertically arranged to support, for example, a work surface, the work surface remains level throughout the range of vertical movement.

16 Claims, 3 Drawing Sheets

HYDRAULIC LIFT WITH YOKED CYLINDERS

BACKGROUND OF THE INVENTION

The present invention relates to hydraulically operated lift systems for work surfaces and, more particularly, to such systems capable of keeping the work surface level during height adjustment.

Employers and workers in industrial environments are becoming increasingly aware of the need for ergonomic workstations. With cross-training of employees and multiple shifts operating in one factory, it is highly desirable that workstations in the industrial setting be adjustable to accommodate workers of various heights and to allow workers to alter their posture from time to time.

Various approaches to raising and leveling smaller workstations and desks include the use of multiple lift cylinders driven by a hydraulic drive. One such system is illustrated in U.S. Pat. No. 5,320,047 to Deurloo et al. The system is mounted on a desk and includes series-connected lift cylinders. A single hydraulic system drives the multiple cylinders. The desk may be re-leveled by extending the cylinders to the limits of their extension and then lowering the desk to a desired height. Another such system is manufactured and sold by Monarch Hydraulic, Inc., the assignee of the present application under the Dyna-Lift trademark. The system includes a plurality of leg cylinders—one for each leg—an a hand-crank actuated hydraulic system providing fluid to the cylinders.

The known systems do not provide sufficient strength and lifting capabilities to raise and lower large industrial workstations, which may weigh many tons, in a level fashion.

SUMMARY OF THE INVENTION

The present invention overcomes the noted problems by providing a hydraulic lift system capable of simultaneously and uniformly actuating multiple lift cylinders attached to a workstation. The lift system enables large and heavy workstations to be raised and lowered in a level fashion. More particularly, the lift system includes a master cylinder, a plurality of slave cylinders, a yoke, and lifting cylinders. The master cylinder drives the yoke. The yoke drives the plurality of slave cylinders. And each slave cylinder drives one lifting cylinder. Because the slave cylinders are yoked together and therefore driven by a single master cylinder, all lifting cylinders remain in phase; and the workstation remains level throughout the range of height adjustment.

The preferred embodiment includes two master cylinders working in tandem, the extension ends of which are attached to the yoke. The yoke is additionally attached to the extension ends of at least two slave cylinders, and the movement of the yoke, caused by the extension of the drive cylinders, forces the slave cylinders to contract simultaneously. The yoke moves with the extension ends and forces the slave cylinders to remain coordinated.

Each of the slave cylinders is in fluid communication with a lift cylinder. As the slave cylinders are compressed by the movement of the yoke, hydraulic fluid is forced out of each of the slave cylinders and into the lift cylinders simultaneously. The lift cylinders extend, thus raising the work surface. Due to the simultaneous compression of the slave cylinders attached to the yoke, the slave cylinders are compressed simultaneously and an equal volume of fluid is pushed out of the slave cylinders and into the lift cylinders at an equal rate. Thus, the lift cylinders extend an equal amount and at the same rate to raise the workstation levelly.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
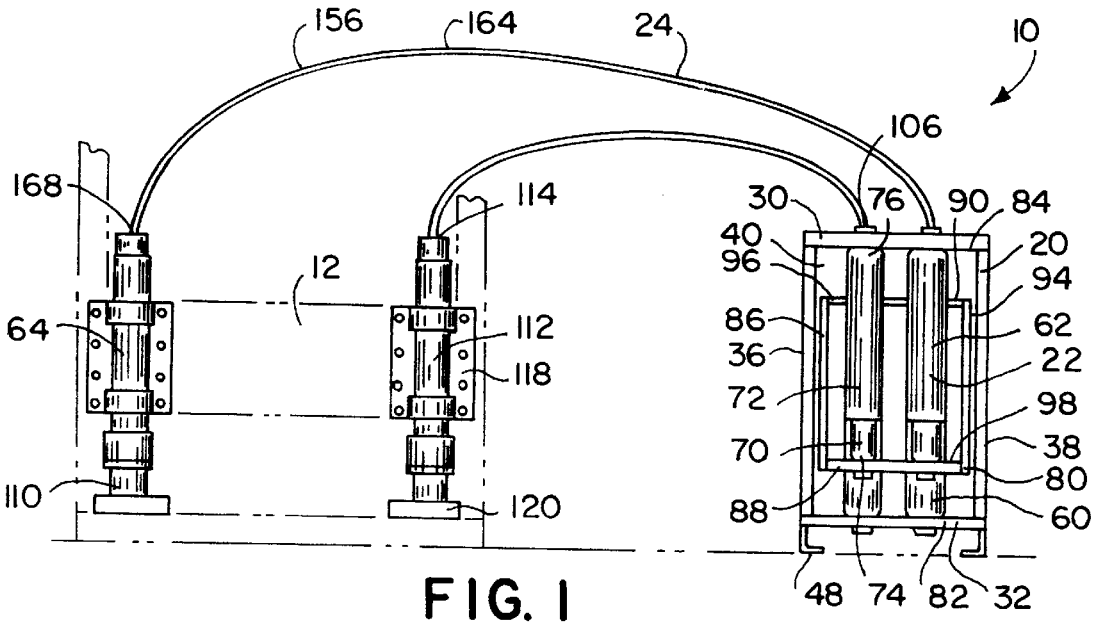
FIG. 1 is an elevational view of the hydraulic lift system connected to the workstation shown in phantom.
Figure 2:
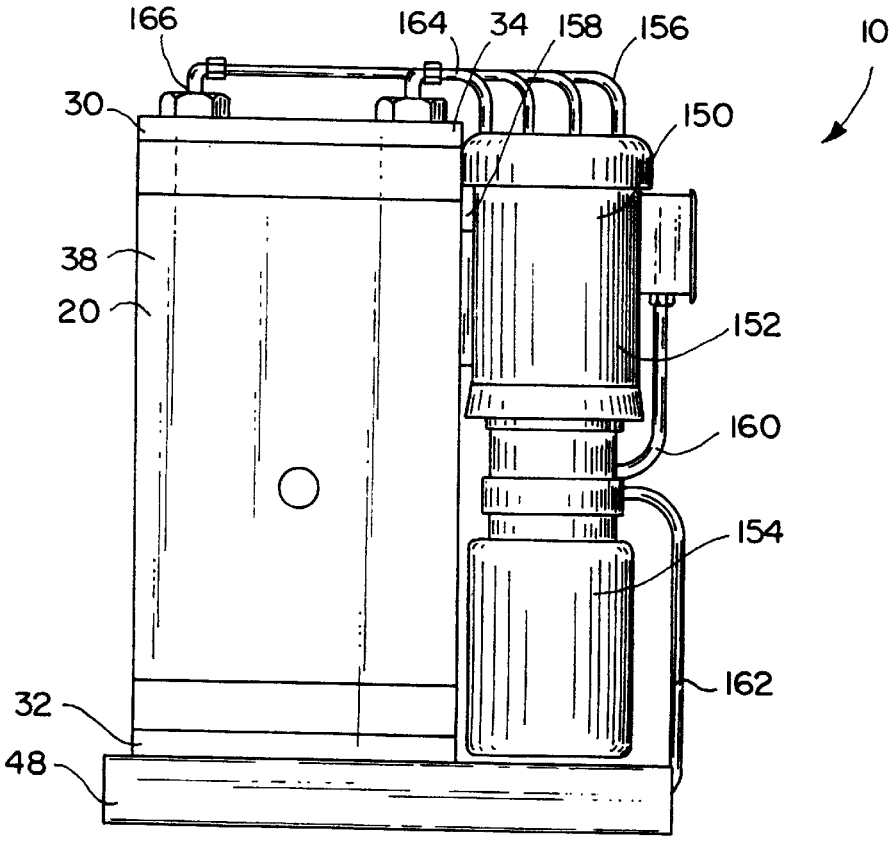
FIG. 2 is a right-side elevational view of the drive unit.

A hydraulic lifting unit according to a preferred embodiment of this invention is illustrated in FIGS. 1 and 2 and generally designated 10. A workstation powered by the unit is generally designated 12. The hydraulic unit 10 includes a housing 20, hydraulic cylinders 22, and a hydraulic circuit 24 amongst numerous of the cylinders 22.

I. Assembly of the Hydraulic System

Preferably, the housing 20 includes a top plate 30, a bottom plate 32, a rear face 34, and left and right side faces 36 and 38 and defines a housing interior 40 having a front 42, middle 44, and rear 46 area. The housing 20 further includes a base 48 having a plurality of bolt holes 50 for securing the housing 20 to a solid surface. The housing 20 is preferably approximately 30 inches tall so that it can be placed under the workstation 12 to minimize the use of floor space.

The cylinders 22 include at least one, and preferably two, master cylinders 60, at least two slave cylinders 62, and at least two lift cylinders 64. The preferred embodiment includes four slave cylinders 62 and four lift cylinders 64. Two of the slave cylinders 62 are positioned at the front 42 of the housing interior 40, and two slave cylinders 62 are positioned at the rear 46 of the housing interior 40. The master cylinders 60 are located in the middle 44 of the housing interior 40. The lift cylinders 64 are attached to the workstation 12.

Figure 3:
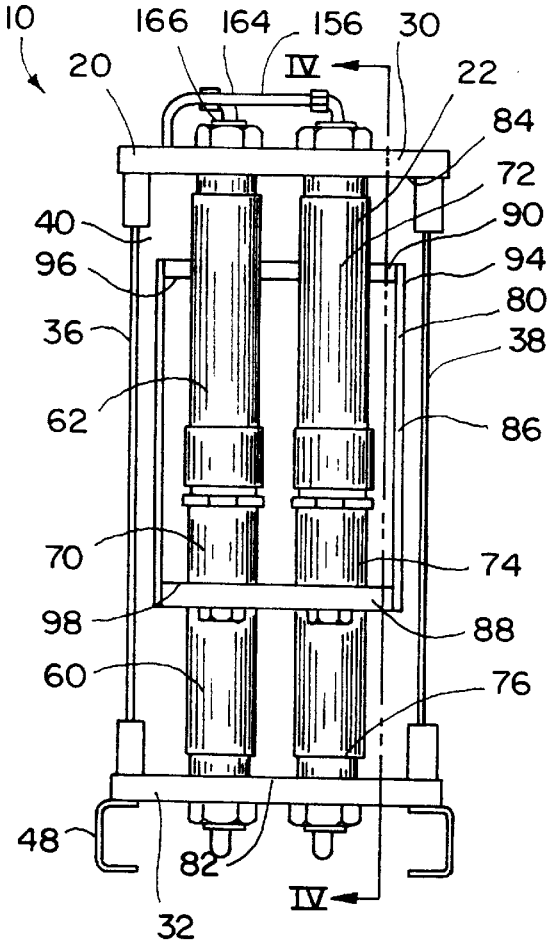
FIG. 3 is a front elevational view of the drive unit.
Figure 4:
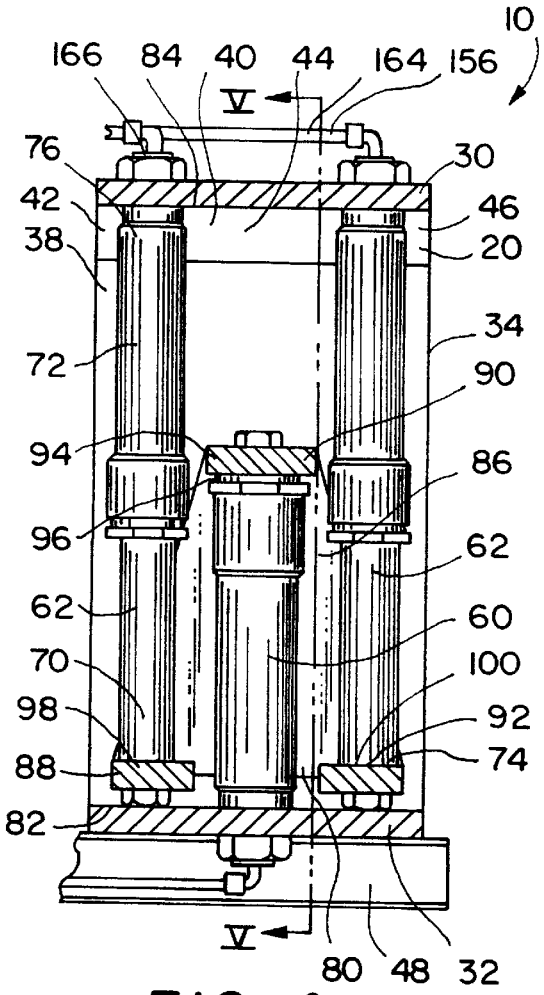
FIG. 4 is a cross-sectional view of the drive unit taken along line IV—IV in FIG. 3.
Figure 5:
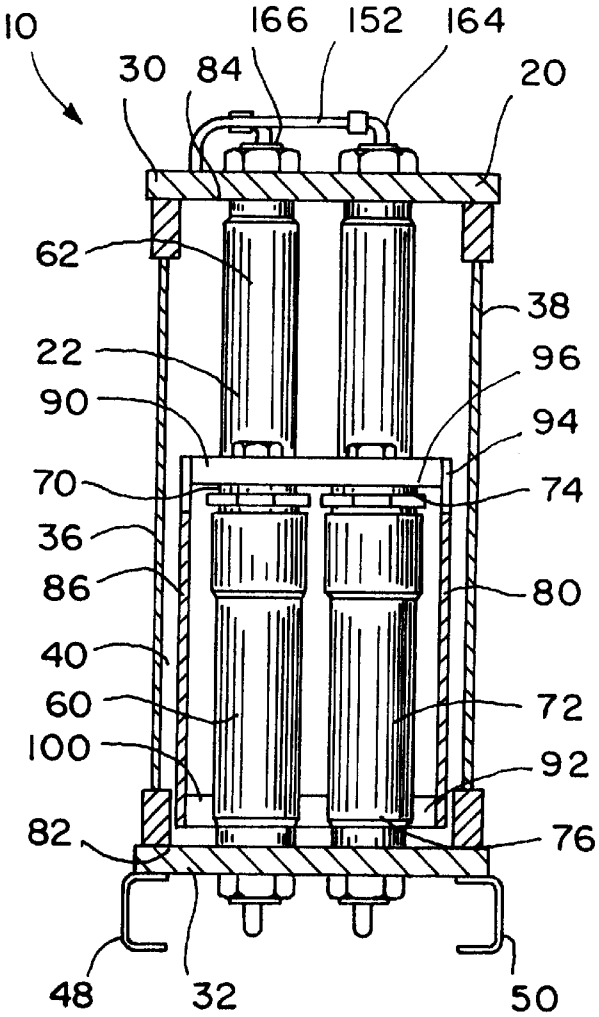
FIG. 5 is a cross-sectional view of the drive unit taken along live V—V in FIG. 4.

As seen in FIGS. 3–5, the master and slave cylinders 60 and 62 are standard hydraulic cylinders which are well known in the prior art. Each master and slave cylinder 60 and 62 includes a piston rod 70 which is slidably interfitted within a cylindrical housing 72. The cylindrical housing 72 defines a sealed interior chamber (not shown) for holding hydraulic fluid. Each cylinder 60 and 62 includes an extension end 74 and a mounted end 76. The extension end 74 corresponds to the end on which the piston rod 70 is fitted, and the extension end 74 is fixedly attached to a yoke 80 which synchronizes movement among the slave and master cylinders 60 and 62. The slave and master cylinders 60 and 62 are mechanically attached to the housing 10 at their mounted ends 76. The mounted ends 76 of the four slave cylinders 62 are attached to an upper surface 82 of the bottom plate 32; the master cylinders 60 are inverted relative to the slave cylinders 62 so that the mounted ends 76 of the master cylinders 60 are attached to a lower surface 84 of the top plate 30. Neither the slave nor the master cylinders 60 and 62 extend the full height of the housing interior 20.

The yoke 80 includes two triangular side plates 86 and three platforms, a front 88, middle 90, and rear 92, connecting the side plates 86. The middle platform 90 is affixed at the apex 94 of the triangular plates 86 and is thus positioned higher than the front and rear plates 88 and 92. Each platform 88, 90, and 92 is preferably horizontal. The extension ends 74 of the master cylinders 60 are affixed to an underside 96 of the middle platform 90. The extension ends 74 of the slave cylinders 62 in the front 42 of the housing interior 20 are affixed to the upper surface 98 of the front platform 88, and the extension ends 74 of the slave cylinders 62 in the rear 46 of the housing interior 20 are affixed to the upper surface 100 of the rear platform 92.

The inverse arrangement allows the housing height to be minimized to approximately 30 inches. Additionally, the housing 20 has a low center of gravity to minimize the chance of tipping and injury on the factory floor.

Figure 6:
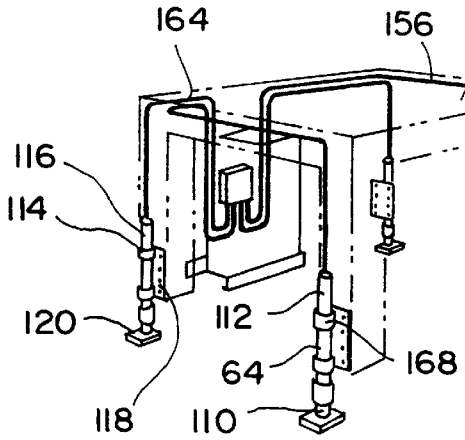
FIG. 6 is a perspective schematic view of the lift cylinders attached to the workstation.

As seen in FIG. 6, the lift cylinders 64 each include a piston rod 110 which is slidably interfitted within a cylindrical housing 112. The cylindrical housing 112 defines a sealed chamber (not shown) for holding hydraulic fluid and an open chamber (not shown). The piston rod 110 fits within the sealed chamber and provides the sealing means at one end of the chamber. The other end of the chamber is sealed with a self-sealing fitting 114, which allows hoses to be disconnected, modifications made to the lift cylinder 64, and hoses reconnected without losing hydraulic fluid or introducing air into the hydraulic system. The open chamber, which extends above the self-sealing fitting 114, has an interior wall (not shown) and an exterior wall 116, the interior wall having a square shape which fits within the exterior cylindrical wall 116. The open chamber extends for 29 inches past the self-sealing fitting 114 in the preferred embodiment and provides the lift cylinder 64 with sufficient height to extend from the floor to the underside of the workstation 12. The height of the lift cylinder 64, including the open chamber, is preferably 48 inches—a height expected to encompass the great majority of industrial workstations 12.

Optionally, as seen in FIG. 6, a mounting bracket 118 may be attached by welding or other method to the lift cylinder 64 to affix the lift cylinder 64 to the workstation 12. In addition, bolt-down pads 120, as seen in FIG. 6, having a circular opening (not shown) may be secured to the floor. The end of the piston rod 110 fits within the circular opening to provide stability to the lift cylinder 64.

Figure 7:
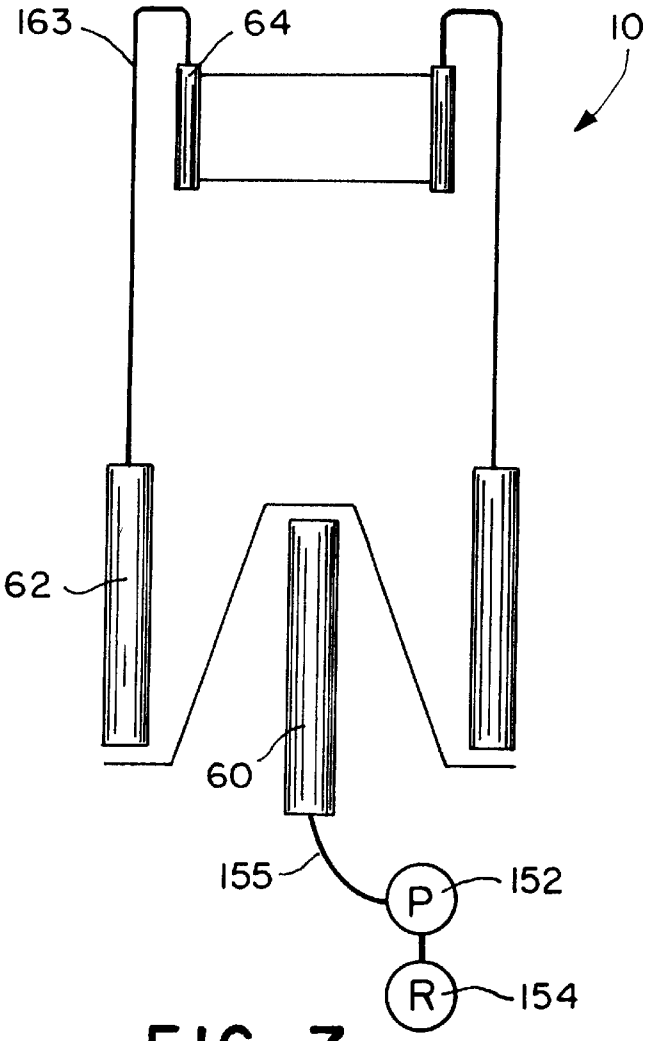
FIG. 7 is a schematic illustration of the hydraulic drive unit and the fluid communication amongst the cylinders.

As seen in FIG. 7, the hydraulic circuit 24 includes an electric motor 150 for driving a hydraulic pump 152, a hydraulic reservoir 154 for storing a first supply of hydraulic fluid (not shown), and a multitude of hydraulic hoses 156. The electric motor 150 has a three position electrical switch (not shown) with positions for "Workstation Up," "Workstation Down," and "Stop/Hold." The pump 152 and reservoir 154 are preferably mounted on the outer surface 158 of the rear face 34 of the housing 20. A hydraulic passage 160 is connected to an adjustable relief valve (not shown) which allows fluid to bypass to the reservoir 154 in the event of excessive fluid pressure. The reservoir 154 is preferably constructed to be fluid-tight but to allow for circuit expansion and contraction such as through the use of an internal bladder, diaphragm, or breather. A hydraulic conduit 162 leads from the pump 152 to a two-way, two-position, normally closed, spring offset, solenoid operated valve (not shown).

Each slave cylinder 62 is in fluid communication with one lift cylinder 64. Hydraulic hoses 164 extend from the outlet ports 166 of the slave cylinders 62 to the inlet ports 168 of the lift cylinders 64, which include the self-sealing fittings 114. A second supply of hydraulic fluid (not shown) is stored within the sealed chambers of the slave and lift cylinders 62 and 64 and in the connecting hydraulic hoses 164. The master cylinders 60 are not in fluid communication with the slave cylinders 62.

II. Operation of the Hydraulic System

The hydraulic lifting unit 10 is installed by affixing the lift cylinders 64 to the workstation 12. The entire length of the lift cylinder 64 may be welded to the workstation 12 or to a mounting bracket 118 or the cylinder 64 may be bolted to the workstation 12.

To raise the workstation 12, the user physically moves the electrical switch to the "Workstation Up" position. The switch activates the pump motor 150. Fluid is then pumped from the reservoir 154 through a check valve (not shown) and into the sealed chambers of the master cylinders 60.

The volume of hydraulic fluid forces the piston rods 70 to slide out of the sealed chambers of the master cylinders 60 and push the middle platform 90 of the yoke 80 upward. This movement causes the front and rear platforms 88 and 92 of the yoke 80 to rise simultaneously, thus pushing the piston rods 70 of the slave cylinders 62 into the sealed chambers of the slave cylinders 62.

The hydraulic fluid is forced out of the sealed chambers of the slave cylinders 62 by the compression of the piston rods 70, and the hydraulic fluid moves into the hydraulic hoses 164. Due to the synchronization of the slave cylinder piston rods 70 by the yoke 80, identical amounts of fluid are forced out of the sealed chambers of the four slave cylinders 62 at identical rates.

The hydraulic fluid moves through the hydraulic hoses 164 and into the sealed chambers of the lift cylinders 64. The increase in fluid volume in the sealed chambers forces the piston rods 110 out of the sealed chambers. The piston rods 110, which in the "down" position preferably rest upon the floor or other solid surface, are pushed against the floor as they move out of the sealed chambers, thus lifting the workstation 12. The movement of the lift cylinders 64 is synchronized due to the identical volume and rate of the hydraulic fluid passing through the hydraulic hoses 164 so that the workstation 12 stays level as it is raised. The length of the piston rods 110 and the amount of hydraulic fluid in the system dictate to what extent the workstation 12 may be raised. In the preferred embodiment, the workstation 12 has a range of movement of 16 inches. To stop and maintain the workstation 12 at any height, the user moves the switch to the "Stop/Hold" position.

To lower the workstation 12, the user moves the electric switch to the "Workstation Down" position. Electrical connections cause the valve to open. This allows the weight of the workstation 12 to force fluid from the sealed chambers of the lift cylinders 64 and out through the hydraulic hoses 164 to the sealed chambers of the slave cylinders 62. The hydraulic power unit 10 0is fitted with pressure-compensated flow control orifice (not shown) that regulates the rate of descent.

The hydraulic fluid moves into the sealed chambers of the slave cylinders 62, thus forcing the piston rods 70 out of the sealed chambers and downward. This movement of the piston rods 70 forces the front and rear platforms 88 and 92, and thus the yoke 80, downward. The middle platform 90 additionally moves downward and forces the piston rods 70 of the master cylinders 60 to slide into the sealed chambers of the master cylinders 60; the fluid is forced out of the sealed chambers and into the hydraulic reservoir 154. To stop and maintain the workstation 12 at any height, the user moves the switch to the "Stop/Hold" position.

The above description is that of a preferred embodiment of the invention. Various alterations and changes can be made without departing from the spirit and broader aspects of the invention as set forth in the appended claims, which are to be interpreted in accordance with the principles of patent law, including the Doctrine of Equivalents.

The embodiments of the invention in which an exclusive property or privilege is claimed are defined as follows:

1. A hydraulic lift system comprising:

a master cylinder;

a plurality of slave cylinders;

a yoke affixed to said slave cylinders and adapted to be driven by said master cylinder, whereby said slave cylinders are driven in unison by said yoke; and a plurality of lift cylinders each in fluid communication with one of said slave cylinders, whereby said lift cylinders are driven in unison by said slave cylinders, whereby a device supported by said lift cylinders will remain level during vertical movement.

2. The hydraulic lift system of claim 1 further comprising:

a fluid reservoir;

a first supply of fluid;

a pump for pumping said first supply of fluid; and fluid passageway means for connecting said pump, said reservoir, and said master cylinder in series.

3. The hydraulic lift system of claim 2 further comprising:

valve means in said fluid passageway means being actuable to direct said pumped first supply of fluid into said master cylinder, thereby causing said master cylinder to extend and move said yoke, said yoke movement thereby causing said slave cylinders to contract simultaneously and force a second supply of fluid into said lift cylinders.

4. The hydraulic lift system of claim 3 wherein said master cylinder is inverted relative to said slave cylinders, whereby said master cylinder and said slave cylinders extend in linearly opposite directions, extension ends of said master and said slave cylinders being affixed to said yoke, whereby the extension of said master cylinder causes the compression of said slave cylinders.

5. The hydraulic lift system of claim 4 further comprising:

a housing including an upper platform and defining a chamber, said master and slave cylinders positioned in said chamber, said master or said slave cylinders attached to an underside of said upper platform, said master and said slave cylinders positioned substantially side by side lengthways.

6. The hydraulic lift system of claim 1 wherein said master cylinder is inverted relative to said slave cylinders, whereby said master cylinder and said slave cylinders extend in linearly opposite directions, extension ends of said master and said slave cylinders being affixed to said yoke, whereby the extension of said master cylinder causes the compression of said slave cylinders.

7. The hydraulic lift system of claim 6 further comprising:

a housing including an upper platform and defining a chamber, said master and slave cylinders positioned in said chamber, said master or said slave cylinders attached to an underside of said upper platform, said master and said slave cylinders positioned substantially side by side lengthways.

8. A hydraulic lift system comprising:

a master cylinder;

a plurality of slave cylinders;

yoke means for mechanically interconnecting said master cylinder and said slave cylinders, whereby said master and slave cylinders have synchronized movement; and a plurality of lift cylinders each in fluid communication with one of said slave cylinders, whereby said lift cylinders are driven by the movement of said slave cylinders to provide coordinated movement.

9. The yoke means of claim 8 further comprising:

a yoke mechanically connecting said master and slave cylinders, said yoke being driven by said master cylinder, said yoke in turn driving said slave cylinders to effect simultaneous movement of said slave cylinders, thereby effecting simultaneous movement of said lift cylinders.

10. The hydraulic lift system of claim 9 wherein said master cylinder is inverted relative to said slave cylinders, whereby said master cylinder and said slave cylinders extend in linearly opposite directions, extension ends of said master and said slave cylinders being affixed to said yoke, whereby the extension of said master cylinder causes the compression of said slave cylinders.

11. The hydraulic lift system of claim 10 further comprising:

a housing including an upper platform and defining a chamber, said master and slave cylinders positioned in said chamber, said master or said slave cylinders attached to an underside of said upper platform, said master and said slave cylinders positioned substantially side by side lengthways in said chamber.

12. An ergonomic workstation comprising:

a height adjustable work area;

a master cylinder including a rod oriented in a first direction;

a plurality of slave cylinders each including a rod oriented in the first direction;

a plurality of lift cylinders attached to said work area and each in fluid communication with one of said slave cylinders;

a yoke having first and second portions, said master cylinder rod affixed to said first portion, said slave cylinder rods affixed to said second portion, said first and second portions arranged to permit longitudinal overlap of said master rod and said cylinder rods.

13. The ergonomic workstation of claim 12 further comprising:

valve means being actuable to direct said pumped first supply of fluid into said master cylinder, thereby causing said master cylinder to extend and move said yoke, thereby causing said slave cylinders to contract simultaneously and force a second supply of fluid into said lift cylinders, thereby causing said lift cylinders to extend simultaneously and raise said workstation.

14. The ergonomic workstation of claim 13 wherein said master cylinder is inverted relative to said slave cylinders, whereby said master cylinder and said slave cylinders extend in linearly opposite directions, whereby the extension of said master cylinder causes the simultaneous compression of said slave cylinders.

15. The ergonomic workstation of claim 14 further comprising:

a housing including an upper platform and defining a chamber, said master and slave cylinders positioned in said chamber, said master or said slave cylinders attached to an underside of said upper platform, said master and said slave cylinders positioned substantially side by side lengthways in said chamber.

16. The ergonomic workstation of claim 15 wherein said housing includes an upper platform, said master cylinder or said slave cylinders attached to an underside of said upper platform.

* * * * *